United States Patent [19]

Hornsby, Jr.

[11] 4,259,805

[45] Apr. 7, 1981

[54] AMUSEMENT DEVICE COMPRISING INFLATABLE DOLL AND SEPARABLE DOLL ENCLOSURE

[76] Inventor: J. Russell Hornsby, Jr., 1119 S. Semoran Blvd., Winter Park, Fla. 32792

[21] Appl. No.: 46,653

[22] Filed: Jun. 8, 1979

[51] Int. Cl.[3] ..... A63H 3/06; A63H 13/16

[52] U.S. Cl. ..... 46/44; 46/88; 46/146; 46/30

[58] Field of Search ..... 46/44, 88, 145, 146, 46/87, 90

[56] References Cited

U.S. PATENT DOCUMENTS

| | | | |
|---|---|---|---|
| 741,360 | 10/1903 | Moseley | 46/44 |
| 1,519,436 | 12/1924 | Brock | 46/88 |
| 2,373,367 | 4/1945 | Wilson | 46/120 |
| 2,674,064 | 4/1954 | Gassaway | 46/90 |
| 3,346,989 | 10/1967 | Ryan et al. | 46/44 |

FOREIGN PATENT DOCUMENTS

| | | | |
|---|---|---|---|
| 1032217 | 3/1953 | France | 46/87 |
| 2012601 | 8/1979 | United Kingdom | 46/44 |

*Primary Examiner*—F. Barry Shay
*Attorney, Agent, or Firm*—Donald A. Kaul

[57] ABSTRACT

A manually operable amusement device consists of a combination of a doll having an inflatable portion, a manually operable inflation means and a separable enclosure in which the doll is disposed. The enclosure has releasable engagement means which are engaged when the doll is uninflated but which are disengaged when the doll is inflated to thereby permit the doll to be removed from the enclosure means. An air release valve is provided in the doll, advantageously in the mouth portion, so that when the doll head is digitally squeezed, the air is released and the doll is deflated. The enclosure means can simulate various types of enclosures, such as a cage, a boulder, a coffin, or the like.

6 Claims, 14 Drawing Figures

FIG 11.
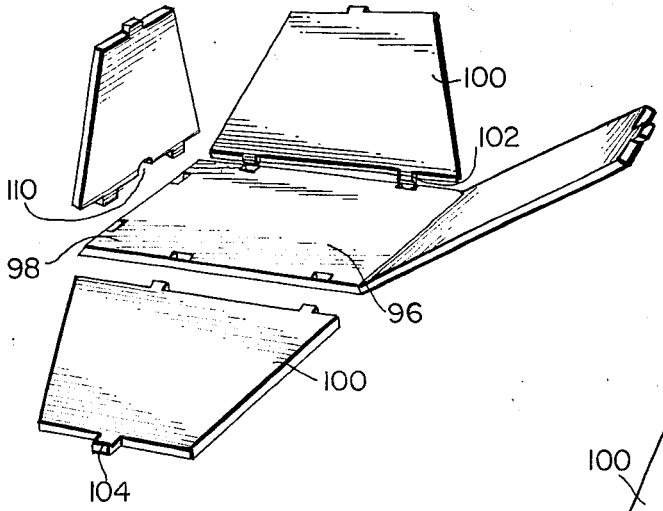
FIG 12.
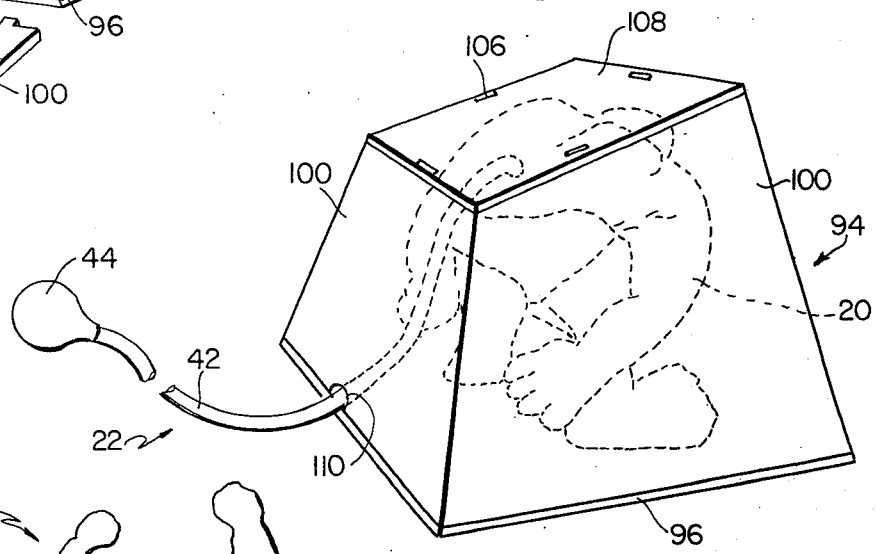
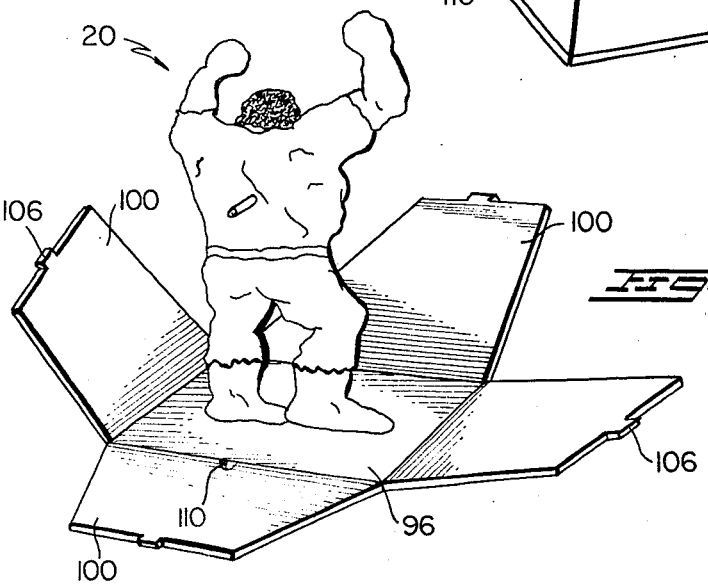
FIG 13.
FIG 14.
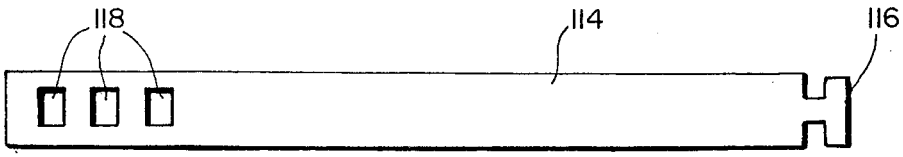

AMUSEMENT DEVICE COMPRISING INFLATABLE DOLL AND SEPARABLE DOLL ENCLOSURE

This invention relates to amusement devices and more particularly it relates to a manually operable amusement device in the form of an inflatable doll and a separable enclosure within which the doll can be disposed.

Dolls have long been a favored form of an amusement device for children of all ages. In addition to dolls themselves, makers of amusement devices have provided doll clothing, doll houses, doll vehicles and other related doll accessories.

An object of the present invention is to provide a unique combination of an inflatable doll and a separable doll enclosure wherein there is a certain coaction between the doll and the enclosure, as the doll is inflated, to thereby let the doll "break out" of the enclosure, thus simulating a feat requiring great strength. In fact, however, the opening of the enclosure is accomplished by inflation of the doll itself.

Another objective of the present invention is to provide a novel form of amusement device which requires use of a child's small motor skills in assembling and operating the amusement device itself. The amusement device of the present invention requires assembly and operation of a manually operable inflation means, assembly of the enclosure means itself, optionally the attachment of separable clothing items, and finally removal of the doll from the enclosure and release of the entrapped air by means of manual deflation of the doll.

Another object of the present invention is to provide an inexpensive form of amusement device, having separable and assemblable parts which can be manufactured and marketed relatively inexpensively.

Other objects, advantages and salient features of the present invention will become apparent from the following detailed description, which, taken in conjunction with the annexed drawings, discloses preferred embodiments thereof.

Referring now to the drawings which form a part of this original disclosure:

FIG. 11 is an exploded perspective view of a modified form of enclosure;

FIG. 12 is a perspective view of the doll housed within the enclosure of FIG. 11;

FIG. 13 is a perspective view of the doll having broken out of the enclosure of FIG. 12; and FIG. 14 is an elevational view of a wrist restraint devise which can be used with the doll.

The foregoing objects are attained by providing a doll having at least a portion thereof, advantageously the upper portion, which is inflatable. In the illustrated advantageous embodiment of doll, the inflatable portion constitutes the upper portion, including the head and upraised arms, while the lower portion is rigid and thus serves as a base for the doll. A manually operable inflation means in the form of a elongated air tube with an air inflation bulb at one end thereof is connectable with an opening in the inflatable portion of the doll. Thus, when the bulb is manually squeezed, air is transmitted into the doll to cause the inflatable portion to expand. The doll is advantageously formed of rubber or other expandable material which is capable of deformation as it is filled with air. As the doll inflates, the upraised arms are elevated slightly due to expansion caused by the inflation. An air release valve is provided, advantageously in the doll's mouth, so that squeezing the dolls' cheeks will release the air and return the doll to its uninflated condition.

The separable enclosure means which forms a part of the combination of the present invention can take various forms. In one advantageous form, the enclosure is formed as a cage having a separate base portion, upstanding sidewalls, and a cover portion. The sidewalls have projections which fit into openings on the base portion. Other projections on the top of the sidewalls interfit with openings in the cover so that the cover can be laid upon the top of the cage, thereby retaining the walls in upright position.

In use, the doll is disposed within the cage and the cover is applied over the top to close the cage. Then, when the bulb is squeezed and the doll is inflated, the arms raise slightly to lift the cover upwardly enough to disengage the projections on the sidewalls from the slots in the cover. This enables the sidewalls to fall outwardly, thereby simulating a condition whereby the doll breaks out of the cage.

In another embodiment of the invention, the enclosure means simulates a rock or boulder. The doll is bent downwardly and inserted into the boulder and as the doll is inflated, it springs upwardly to knock the cover open. Other advantageous forms of enclosure means for use in connection with the doll can include a coffin or a table to which the doll is strapped.

In addition, the present invention contemplates the use of separable garment means which can be attached or applied to the doll and held together by Velcro sections will pull apart to simulate the doll ripping out of its garment.

Figure 1:
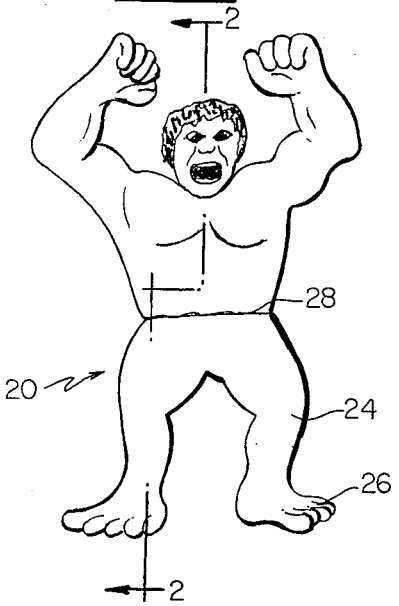
FIG. 1 is a front elevational view of an inflatable doll in accordance with the principles of the present invention.
Figure 2:
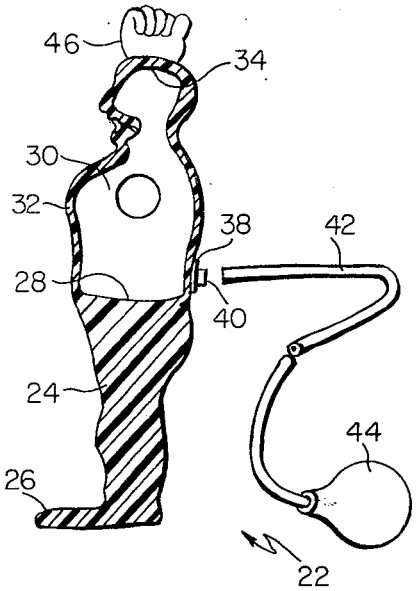
FIG. 2 is a sectional view thereof taken along the line 2—2 of FIG. 1.

Referring now to the drawings in further detail the doll of the present invention is illustrated in FIGS. 1 and 2 and is generally designated 20. Manually operable inflation means generally designated 22 are connectable with the doll 20. The doll 20 includes a lower non-inflatable portion including legs 24, feet 26, and a lower body portion extending up to a waist 28. Although this lower portion is advantageously formed of the same rubber or other elastomeric material as the remainder of the doll 20, it is nevertheless rigid enough to provide a means for supporting the doll in an upright condition resting upon the lower surface of the feet 26. Advantageously, the doll is rotationally molded and formed of polyvinyl chloride.

The upper portion of the doll is the inflatable portion which has a cavity 30 therein. The cavity 30 is provided within a hollow chest portion 32, a hollow neck and head portion 34 and hollow upraised arms 36. The inflatable upper portion is advantageously formed with a hardness measured on the A scale of 45–50 durometers while the non-inflatable lower portion has a hardness of 80–95 durometers by comparison.

An inflation collar 38 having a short projecting neck 40 thereon communicates with the internal chamber 30. Advantageously, the collar 38 is mounted in the lower back portion of the doll 20.

Figure 3:
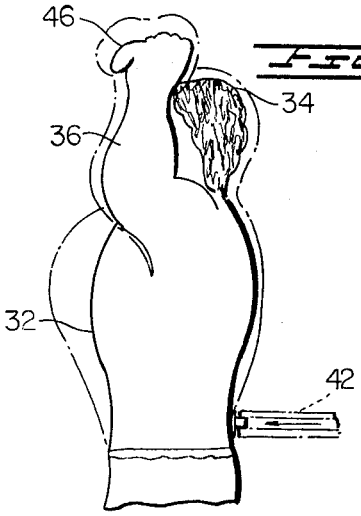
FIG. 3 is a fragmentary side elevational view showing the doll in uninflated condition in solid lines and in inflated condition in phantom lines.

The inflation means 22 consists of a elongated tube 42 which has a squeezeable air bulb 44 at one end thereof. The other end of the tube 42 connects with the neck 40, as illustrated in FIG. 3, to enable air to be pumped into the chamber 30.

The upper or inflatable portion of the doll 20 is movable between a first or uninflated position and a second or inflated position. In FIG. 3, the first or uninflated position is shown in solid lines while the second or inflated position is shown in phantom or dashed lines. As can be seen, when the chamber 30 is filled with air, by operation of the bulb 44, the chest 32 expands outwardly, the head 34 raises slightly, and the arms 36 also raise slightly. The hands at the end of the dolls' arms 36 are shown in the form of fists 46 and these fists likewise raise upward slightly as the arms raise during the inflation process.

Figure 4:
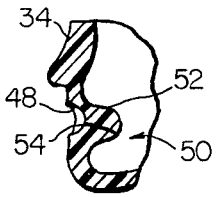
FIGS. 4 and 5 are fragmentary sectional views showing the air release valve respectively in its closed and open positions.
Figure 5:
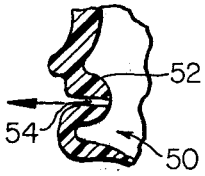
Figure 6:
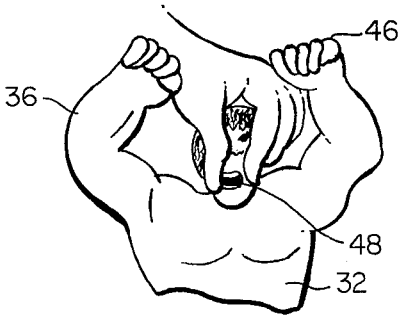
FIG. 6 is a fragmentary diagramatic view showing the manner of operation of the air release valve.

Valve means must be provided to enable the air to be released from the inflation chamber 30 in the doll. Advantageously, this valve means is formed as a duckbill valve provided in the mouth 48 of the doll. As shown in FIGS. 4 and 5, the valve means generally designated 50 includes an inward projecting bead 52 of resilient material having a slit 54 form therein and extending from the mouth 48 into the interior of the head 34. The bead 52 is configured in such a fashion that normally the slit 54 is closed by the resilient nature of the material. It will be noted that the bead 52 is somewhat downwardly directed, as illustrated in FIG. 4, so that as air is pumped into the inflatable chamber 30, it tends to squeeze the slit 54 closed so that no air escapes therethrough. However, when the valve 50 is opened, which can be digitally accomplished as shown in FIG. 6 by an inward squeezing of the cheeks of the doll head 34, the slit 54 is opened as shown in FIG. 5 and the entrapped air is permitted to escape. This enables the operator to quickly and easily return the doll to its uninflated condition whenever that is considered necessary or desirable. A pressure of approximately 2 psi is required to open the valve 50.

Figure 7:
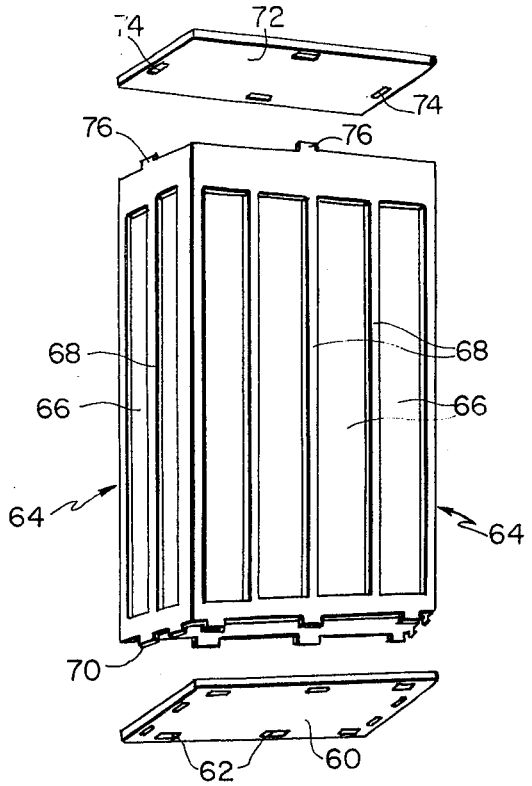
FIG. 7 is an exploded perspective view of a separable enclosure in accordance with the principles of the present invention.

Referring now to FIG. 7, there is illustrated therein one form of separable enclosure having releasable engagement means. The enclosure of FIG. 7 is in the form of a receptacle including a base portion 60 having a series of slots or opening 62 formed about the perimeter thereof and a set of four upstanding sidewall members generally designated 64, each of which, in this embodiment, is configured to represent a cage by having alternate large openings 66 set off by narrow simulated bars 68. At the bottom of the wall 64, projections 70 are provided to fit into the slots 62. The slots 62 are somewhat oversized with respect to the projections so that when the sidewalls are assembled with the base 60, they tend to fall outwardly and are not retained in upright condition merely by engagement of the projections 70 in the slot 62.

The enclosure means also includes a cover 72 having four slots 74 formed therein along all four perimetal edges. One projection 76 is provided along the top of each of the sidewalls 64 and positioned in such a way as to fit within the slots 74 of the cover 72. The combination of the cover slots 74 and the sidewall projections 76 form a releasable engagement means in that the cover sits freely upon the top edges of the sidewall 64 and retains those sidewalls in upstanding position by virtue of engagement of the projections 76 in the cover slots 74.

Figure 8:
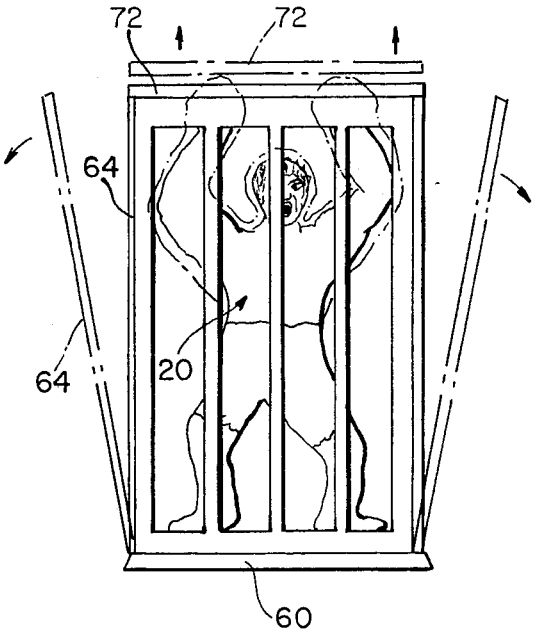
FIG. 8 is a front elevational view showing the doll and enclosure in combination, with the combination in solid lines being in closed position and the combination in phantom lines being in open position.

In use, the doll 20 is placed in a standing position upon the base 60 and the enclosure or cage is then assembled, first, by inserting the sidewalls into the base, and second, by positioning the cover 72 on top of the upstanding sidewalls. In this way, the doll 20 gives the simulated appearance of being entrapped within a cage or jail cell. The inflation means 22 is connected with the doll as it is positioned within the enclosure. As the inflation means is manually operated, thereby causing the doll chamber 30 to become inflated with air, the upper portion of the doll expands. The illustrated expansion in FIG. 8 is similar to that shown in FIG. 3, namely, the solid lines show the uninflated condition while the dotted or phantom lines show the inflated condition. During the inflation process, the hands or fists 46 raise slightly as the arms are inflated. This raising lifts the cover 72 upwardly to the phantom line position shown in FIG. 8 and disengages the slots 74 from the projection 76 on the sidewalls. When this occurs, the sidewalls 64 will fall outwardly, as illustrated in FIG. 8, and the doll will then have "broken out" of its surrounding enclosure, receptacle, or cage.

Figure 9:
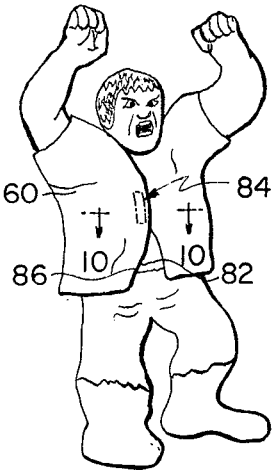
FIG. 9 is a perspective view of the doll of the present invention with separable garment means attached thereto.
Figure 10:
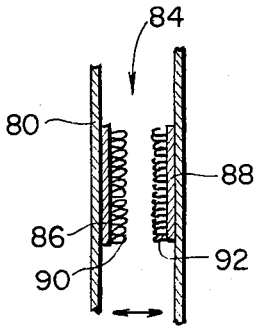
FIG. 10 is a fragmentary sectional view taken along the lines 10—10 of FIG. 1.

It is also within the purview of the present invention to provide a separable garment means to be used in combination with the doll. This garment, advantageously in the form of a shirt, is illustrated in FIG. 9 and consists of a shirt 80 having a pair of opposed front edges 82 which enable the shirt to be applied over the inflatable portion of the doll's body. Releasable interengagement means generally designated 84 are provided along the edges 82 of the shirt 80 to enable the garment to be closed. As illustrated in FIG. 10, this releasable interengagement means 84 consists of a pair of mating portions 86 and 88. The portion 86, connected along one edge 82 of the garment 80, is provided with a multiplicity of flexible loop members 90 formed of fine filamentary plastic. The portion 88, connected along the other edge 82 of the garment, is provided with a multiplicity of flexible hook members 92 also formed of filamentary plastic. These loop members 90 and hook members 92 are engageable with one another merely by manually pressing the sections 86 and 88 into contact with one another. These hook and loop portions are commercially available and are sold under the trademark Velcro.

In use, the garment 80 is applied over the doll 20 when the doll is uninflated. The mating Velcro sections 84 are pressed together, thereby closing the shirt or other garment. However, as the inflatable portion of the doll is inflated and air fills the inflatable chamber 30, the chest 32 of the doll expands in size, thereby pulling the edge portions 82 of the garment apart until the Velcro sections finally separate one from the other. This condition thus simulates the doll "breaking out" of its shirt or other garment.

The invention contemplates the use of various different forms of enclosures to be used in combination with the inflatable doll. Another such enclosure is illustrated in FIGS. 11–13 and takes the form of a simulated boulder formed of separable parts. This enclosure, generally designated 94, includes a base 96 having a series of slots 98 formed about its periphery and four upstanding somewhat trapezoidal sidewall members 11 adapted to fit into the base 96. The sidewalls 100 have projections 102 at their lower ends to fit into the base slots 98. They also have projections 104 at their upper ends which fit into slots 106 about the periphery of a cover or top wall 108, as shown in FIG. 12. One of the sidewalls 100 has a small central opening 110 formed at its lower edge to enable the inflation tube 42 to fit into the enclosure.

As shown in FIG. 12, in order to position the doll 20 within the enclosure 94, the uninflated doll is bent over and the arms 36 are locked behind the knees along the legs 24 of the doll. When the bulb 44 of the inflation means is operated to inflate the doll, the chest portion will gradually become inflated which will cause the arms 36 to pull away from the engagement behind the legs 24. As this occurs, the doll will resiliently spring upward, moving from its dotted line position of FIG. 12 to its solid line position of FIG. 13. This movement, in turn, lifts the cover 108 upward, thereby releasing the side walls 100 to fold outwardly as shown in FIG. 13.

As an added restraining feature, wristcuffs can be provided for the doll 20. These wristcuffs, as shown in FIG. 14, are formed as a strap 114 having a shaped projection 116 at one end thereof and a series of adjustment holes 117 adjacent the opposite end thereof. When the strap is wrapped around the doll's wrists and the projection 116 is inserted into one of the holes 118, the wrists are held together. However, as the doll is inflated and the arms tend to pull apart due to chest inflation, the projection 116 will be pulled out of its hole 118 and the arms will rapidly fly upwardly, thus causing the enclosure to literally break apart.

Various other forms of enclosure means are also within the purview of the present invention. For example, the enclosure can simulate the form of a coffin. The doll can be inserted in the coffin with the arms disposed along the sides and with the cover of the coffin being releasable, much in the manner of the cover shown on the cage in FIGS. 7 and 8. As the doll is inflated, one arm folds across the chest and the other folds behind the back. The cover is thus lifted away to thus enable the doll to "escape" from the coffin. It is also possible to have the doll strapped to a table by straps which have Velcro attachment means thereon. As the doll is inflated, it can "break" the straps to escape from attachment to the table.

Various other changes and modifications apparent to those skilled in the art may be made without departing from the spirit and scope of the invention as deinfed in the appended claims.

What is claimed is:

1. A manually operable amusement device comprising:

a toy figure in the form of a doll;

said doll having a hollow chamber formed therein;

said doll having an inflatable portion surrounding said hollow chamber and being formed of elastomeric material;

manually operable inflation means connected with said doll to enable air to be pumped into said hollow chamber to thereby cause the elastomeric material of said inflatable portion to expand;

said doll having a flat support base to enable it to stand upright; and a separable enclosure means into which said doll can be inserted;

said doll and said inflation means being completely free from attachment to or connection with said enclosure means;

said enclosure means having releasable engagement means which, in a first position are interengaged, and which, in a second position, are disengaged;

said releasable engagement means being disposed in said first position when said doll is inserted into said enclosure means and before said doll is inflated;

said releasable engagement means being moved to said second position when said inflation means is operated to cause said elastomeric material of said inflatable portion to expand into contact with said enclosure means, thereby simulating the appearance of the doll breaking out of the enclosure means.

2. A manually operable amusement device as defined in claim 1 further including a restraint device adapted to releasably attach the doll's arms together, said restraint device comprising an elongated strap having aperture means formed therein and having a projection adapted to releasably connect with said aperture means.

3. A manually operated amusement device as defined in claim 1 wherein said doll includes valve means located in said inflatable portion, said valve means normally being closed to permit said inflatable portion to be inflated but being digitally operable to deflate said portion by releasing the accumulated air.

4. A manually operable amusement device as defined in claim 3 wherein said doll includes a head which forms a part of said inflatable portion and wherein the valve means is located in the mouth of said doll head.

5. A manually operable amusement device comprising the combination of a doll having at least a portion thereof which is manually inflatable;

a separable enclosure at least partially surrounding said inflatable portion of said doll;

manually operable inflation means;

said separable enclosure having releasable engagement means which, in a first position are interengaged, and which, in a second position are disengaged;

said releasable engagement means being disposed in said first position when said doll is uninflated and being moved to said second position when said doll is inflated by operation of said manually operable inflation means, and separable garment means positioned upon the inflatable portion of said doll, said separable garment means having edge portions with releasable interengagement means thereon.

6. A manually operable amusement device as defined in claim 5 wherein said releasable interengagement means includes two mating portions, one of which comprises a multiplicity of flexible hook members and the other of which comprises a multiplicity of flexible loop members, said mating portions being interengageable by manually pressing one into contact with the other.

* * * * *